US006131372A

United States Patent [19]

Pruett

[11] Patent Number: 6,131,372

[45] Date of Patent: Oct. 17, 2000

[54] ARTICLE METERING DEVICE AND METHOD OF METERING ARTICLES

[75] Inventor: Daniel W. Pruett, Colbert, Ga.

[73] Assignee: Food Machinery Sales, Inc., Athens, Ga.

[21] Appl. No.: 09/210,920

[22] Filed: Dec. 14, 1998

[51] Int. Cl.[7] ..... B65B 35/30

[52] U.S. Cl. ..... 53/448; 53/543; 198/419.1; 198/419.2; 198/419.3; 198/461.3

[58] Field of Search ..... 53/448, 543; 198/418.7, 198/419.1, 419.2, 419.3, 461.2, 461.3

[56] References Cited

U.S. PATENT DOCUMENTS

| | | |
|---|---|---|
| 2,991,869 | 7/1961 | Packman et al. . |
| 3,155,221 | 11/1964 | Griner . |
| 3,162,294 | 12/1964 | Dieter . |
| 3,572,495 | 3/1971 | Luginbuhl . |
| 3,575,278 | 4/1971 | Hoffmann et al. . |
| 3,747,739 | 7/1973 | Fuchs et al. . |
| 3,805,476 | 4/1974 | Kawamura et al. . |
| 3,812,948 | 5/1974 | Luginbuhl . |
| 3,938,650 | 2/1976 | Holt . |
| 4,041,677 | 8/1977 | Reid . |
| 4,296,590 | 10/1981 | Focke . |
| 4,360,098 | 11/1982 | Nordstrom . |
| 4,507,908 | 4/1985 | Seragnoli . |
| 4,514,963 | 5/1985 | Bruno . |
| 4,535,881 | 8/1985 | Mims . |
| 4,630,725 | 12/1986 | Steurmer . |
| 4,771,877 | 9/1988 | Langen . |
| 4,815,581 | 3/1989 | Deutschlander . |
| 4,843,799 | 7/1989 | Simelunas et al. . |
| 4,878,337 | 11/1989 | Raudat et al. . |
| 4,934,510 | 6/1990 | Lutgendorf . |
| 4,962,625 | 10/1990 | Johnson et al. . |
| 4,998,399 | 3/1991 | Lutzke et al. . |
| 5,020,655 | 6/1991 | Cruver . |
| 5,038,915 | 8/1991 | Delsanto . |
| 5,097,939 | 3/1992 | Shanklin et al. . |
| 5,287,954 | 2/1994 | Draghetti . |
| 5,303,811 | 4/1994 | Haley . |
| 5,634,549 | 6/1997 | Mims . |

OTHER PUBLICATIONS

Food Machinery Sales, Inc.—Model TP–X Cookie Tray Loader pamphlet.

Food Machinery Sales, Inc.—MACH 3 Horizontal Wrappers; 6 pages.

*Primary Examiner*—Daniel B. Moon

*Attorney, Agent, or Firm*—Needle & Rosenberg, P.C.

[57] ABSTRACT

An article metering device, and a method of metering articles, is disclosed. The article metering device is positioned along a path of travel at a downstream end of a feed conveyor, and at an upstream end of a take-away conveyor of an article handling and packaging system. The article metering device is constructed and arranged to accumulate a first queue of articles on the feed conveyor, to accumulate a second queue of articles on the take-away conveyor, to space the respective articles within the second queue of articles from one another, and to then selectively advance selected ones of the articles within the second queue of articles along the path of travel for being carried on the take-away conveyor toward an infeed conveyor of a downstream packaging machine. The metering device is constructed and arranged to selectively release rows of articles along the path of travel in timed relationship to the operation of the downstream packaging machine

37 Claims, 8 Drawing Sheets

ARTICLE METERING DEVICE AND METHOD OF METERING ARTICLES

FIELD OF THE INVENTION

The invention relates in general to food packaging machinery. More particularly, the invention relates to an article metering device and a method of metering articles in which baked foodstuffs, for examples cookies and crackers, are metered as they are passed along an article handling and packaging system toward a downstream food packaging machine.

BACKGROUND OF THE INVENTION

Modern baking plants are capable of producing large quantities of baked foodstuffs, for examples, cookies, crackers, and the like. However, in order to attain full operating efficiencies in the baking operations conducted in these plants, the article handling and packaging systems used to handle and package these articles, respectively, must be constructed to efficiently and quickly process these large quantities of articles. The article handling and packaging system thus needs to move the articles away from the baking oven toward a downstream packaging machine while simultaneously ordering and metering the articles as they pass along a path of travel defined by the handling and packaging system, for example forming the articles into separate article lanes and then forming spaced rows of articles therefrom such that the articles will be packaged efficiently and quickly.

Due to the great numbers of baked foodstuffs produced in modern baking plants, however, coupled with the limitations of existing article handling and packaging systems technology, the problem arises that baked foodstuffs can be produced much more quickly than they can be efficiently handled. Moreover, it is desirable to have as little human handling of the articles as possible in order to prevent product breakage or damage which is undesirable, as well as for health and safety reasons such that any potential health risks to the end consumer of the article are minimized. Thus the need exists to be able to control the articles, form them as desired for packaging configurations, package the articles, and ship them quickly, efficiently, and economically.

One of the problems in controlling articles to be packaged is to move the articles rapidly along an article handling and packaging system, yet space them so that the articles can be individually controlled and thus positioned in desired spaced relationships not only with respect to one another, but also with respect to the packaging machine such that the desired article configurations are packaged quickly. The sorting apparatus for food items of U.S. Pat. No. 4,535,881 to Mims represents an early attempt to respond to this need by providing a conveying and sorting apparatus for sorting food items into parallel lines of uniformly spaced food items.

Two rotary members are provided by the device of Mims for each line, or lane, of food items. Each of the rotary members is positioned above and perpendicularly with respect to the line of articles, and is constructed to have a central hub with a plurality of retractable spokes or fingers which extend radially therefrom, and move reciprocally from an extended position into a retracted belt engaging position. As constructed, the sorting apparatus of Mims thus will always have a minimum of two of these spokes in contact with the surface of the conveyor belt at any one time. The food items passed along the conveyor will engage the spokes of the rotary members much as a chain engages the teeth of a sprocket to maintain a uniform spacing between the food items.

A drawback of the Mims device, however, is that at least two, and oftentimes four of the spaced radial fingers or spokes of the device are engaged with the surface of the conveyor belt. This, of necessity, limits the speed with which the machine can operate as the mechanical motion of reciprocating the fingers must be accommodated without moving them so quickly as to cause them to become jammed or damaged, and may also allow the spokes to come down and strike or land on top of an article which is otherwise out of position on the conveyor such that the article is damaged or destroyed, and which may also damage the indexing device itself.

Another drawback with the device of Mims is that it does not appear to be adapted for the quick changeover for handling differing product shapes, sizes or packaging configurations as disassembly of the device will be required in order to change the spacing of the spokes to accommodate a differently sized article. For example, in order to accommodate articles of a certain size, the spokes of the Mims device must be spaced far enough apart to allow successive ones of the articles to be received by a respective pair of the fingers of the indexing device. If these articles become significantly larger, for example, then as a first set of fingers engages an article, the second set of fingers will tend to come down into engagement with the topmost surface of the article. If the article is significantly smaller, then it may be allowed to pass between a pair of fingers if spaced too widely apart, and will likely also require that the rotary indexing device be run at a very fast rate of speed in order to allow for an efficient operation of the article handling and packaging system, i.e. obtaining a satisfactory production yield.

Lastly, another potential drawback with the Mims device is that the conveyor belt on which the articles are being carried beneath the indexing device must be moved very quickly in order to allow the articles to be spaced as they leave the set of fingers with which they were engaged as nothing is disclosed in Mims which would otherwise indicate that the speed of the indexing device may be varied in response to a downstream packaging machine, for example.

Another approach to solving the problem of spacing articles carried along a conveyor on an article handling and packaging system is disclosed in U.S. Pat. No. 5,303,881 to Haley, which discloses a spacer system for a surface conveyor. Haley provides a metering device which is constructed and arranged to engage and release foodstuffs being moved along a path of travel on a conveyor belt such that relative positions of the foodstuffs on the conveyor belt are spaced at a predetermined interval, or intervals. This is accomplished by providing a spaced pair of fingers which extend in the downstream direction and which are reciprocated up and down to allow articles to pass therebeneath. The fingers of the Haley device come down, preferably, in the space located between abutting articles, for example in a gap created between the articles within a queue of articles formed on the conveyor, upstream of the device.

A drawback with the device of Haley, however, is that as the fingers of the device are reciprocated up and down, this limits the speed with which the fingers can be moved in association with the speed of the conveyor belt to allow a sufficient amount of time for the articles to pass therebeneath and to be spaced thereby without otherwise striking and destroying articles as they are passed through the system. Moreover, the device of Haley is not well suited for use with all types of articles, for example chocolate covered or enrobed cookies and snack cakes. For example, as the spaced fingers of the Haley device are moved downward they may strike the article, especially if the article is relatively soft, for example a soft baked cookie, with enough force that they may become imbedded in the article. The possibility also exists that as the fingers pass over and along the surface of the article they may either scrape off or become fouled with the covering or icing on the surface of the article. In either instance, this may cause the feed conveyor and/or the spacer device to become jammed by the article(s), will likely damage the articles, and/or may damage the device itself.

Both, the device of Haley and the device of Mims described above, are constructed to index a uniformly sized and shaped article. In Haley, this uniformly shaped article must be relatively flat so that when and if the fingers land on the top surface of an article being spaced thereby, the fingers are allowed to slide over as the article as it continues to pass therebeneath, whereupon the fingers will then fall into the gap between the article and the next succeeding article. Neither of the devices to Haley, nor to Mims, however, are constructed and arranged to either form or control a second queue of articles therewith. For example, neither device, once it spaces an article and releases same along the path of travel, is adapted to selectively control the position of selected articles along the path of travel such that the possibility arises that the articles may become spaced too closely together, or too far from one another with a resulting inefficiency in packaging machine operation because a controlled flow of articles is not being fed to the downstream packaging machine. This may result in an undesirable increase in production costs and packaging machine wear due to having to stop and start the packaging machine because of either too many or too few articles being available for packaging.

What appears to be needed, but is seemingly unavailable in the art, is a simple and reliable article metering device that will allow for improved production rates, and thus improved operating efficiencies and production yields, in use. Moreover, the need for such an improved article metering device exists which will provide a flexible device, and a metering method, for handling a variety of article types and sizes easily and efficiently, and which provides an adequate degree of flexibility in usage so that it can be quickly changed over to handle articles of a variety of sizes and shapes. It is also desirable that such an article metering device not engage the conveyor belt passing therebeneath, and be constructed to control the relative positions of an accumulate queue of articles as they are passed therethrough in order to ensure that proper spacing of the articles is maintained as they pass along the article handling and packaging system. Lastly, there is a need for an improved article metering device, and an article metering method using such a device which does not rely upon spokes or fingers which are spring-loaded or mechanically driven into engagement with a belt and which are then retracted so as to minimize the likelihood of mechanical wear or breakage to the device, and which also will tend not to damage the articles if the articles are struck by the device as they are being processed.

SUMMARY OF THE INVENTION

The present invention provides an improved article metering device, and a method of metering articles, for example foodstuffs passing along an article handling and packaging system, which overcome some of the deficiencies of the known article metering devices in the art. The article metering device and method of this invention provide a simple, efficient and highly flexible device and method, respectively, for metering articles of a variety of sizes and shapes, and allows for increased control over the articles so that the articles may be more precisely spaced apart from one another in usage, which thus allows for greater packaging operating speeds and improved production yields than previously anticipated in the art. The present invention also provides for an improved article metering device which can be changed over quickly and easily for handling articles of a variety of sizes, and does not physically strike any conveyor belts passing therebeneath. Another feature of the present invention is that it allows for slower conveyor belt operating speeds as the metering device itself will control the articles for spacing purposes in a separate queue, rather than requiring an over-speed conveyor belt to space the articles apart from one another downstream of the metering device.

The improved article metering device of this invention thus allows for a new method of metering articles being advanced along a path of travel on a feed conveyor of an article handling and packaging system in which the articles are to be passed therealong toward a downstream packaging machine. This novel method comprises the steps of accumulating a first queue of articles on the feed conveyor with an article metering device positioned with respect thereto; accumulating a second queue of articles on a take-away conveyor positioned downstream of the feed conveyor with the metering device, while also using the metering device to space the respective articles within the second queue of articles apart from one another; selectively advancing selected ones of the articles within the second queue of articles along a path of travel toward a packaging machine infeed conveyor; and lastly, in response thereto, placing the selected ones of the articles on a downstream infeed conveyor for being advanced toward the packaging machine.

The method of this invention also includes timing the operation of the metering device with respect to the operation of the downstream packaging machine, or any other desired upstream or downstream article handling or processing station, such that the articles are metered on an as needed basis for preventing an underfeed or overfeed situation at a downstream processing station, for example. The articles in the first queue of articles are held in separate lanes of articles as they are brought into the metering device, and are formed by the metering device into a series of spaced rows of articles across the lanes thereof on the take-away conveyor. The metering device may release one row of article at a time, or may continuously release rows, all as desired.

The step of accumulating the first queue of articles with the metering device includes moving an article engagement member in a linear direction along a path of travel, stopping the engagement member at a predetermined position along the path of travel in front of the articles being carried on the feed conveyor, and in response thereto forming the first queue of articles upstream of the article engagement member on the feed conveyor. The step of forming the second queue of articles includes moving the article engagement member from the predetermined position in the direction of the path of travel, and moving a second successive article engagement member along the path of travel and into the predetermined position in front of the remaining ones of the articles within the first queue of articles. This step also includes moving the second article engagement member downwardly into a gap created between adjacent ones of the articles within the first queue of articles as the respective ones of the articles are passed from the feed conveyor onto the take-away conveyor.

This step of moving the second article engagement member into the gap so defined includes moving the article engagement member in a linear direction along the path of travel in engagement with a wear strip which also extends in the direction of the path of travel, and which is spaced above at least a portion of the first queue of articles, and then moving the article engagement member downwardly with the force of gravity into a gap formed between the articles as they pass from the feed conveyor onto the take-away conveyor, whereupon the article engagement member falls off a downstream end of the wear strip.

The article metering device of this invention includes a framework positioned along the path of travel with respect to the feed conveyor and the take-away conveyor. The framework has a first end and a spaced second end, with a pair of spaced and parallel side frame members extending between the ends thereof. A plurality of elongate carrier members extend between the side frame members, the carrier members being carried in spaced series along the path of travel on a pair of endless drive chains extending between the first and second ends of the metering device framework, with at least one article engagement member carried on each respective one of the carrier members. Each such article engagement member is constructed and arranged to move from a first retracted position, through the force of gravity, into a second extended article engaging position spaced above the take-away conveyor in an article engaging position.

The endless drive chains are separately passed about a respective one of a pair of drive sprockets mounted on a rotatable drive shaft, the drive shaft being turned by a suitable drive motor, and a respective one of a pair of spaced idler sprockets rotatably supported on an idler shaft spaced from the drive shaft. The article engagement members are held in their retracted position as the endless drive chain and carrier members, respectively, move from the second end toward the first end of the framework, and fall into the extended position as the carriers pass about the respective drive sprockets and onto a wear strip spaced above the feed conveyor and extending at least partially along the path of travel at the first end of the article metering device. As the respective carrier members continue to move along the path of travel from the first end toward the second end of the metering device, the respective article engagement members pass along the wear strip until they fall off of a downstream end thereof and into a gap created where the articles are passed from the feed conveyor onto the take-away conveyor.

It is, therefore, an object of the present invention provide an improved article metering device and method of metering articles which provides greater reliability in operation, and thus allows for increased production rates and production yields.

Another object of the present invention is to provide an improved article metering device and method of metering articles which will have greater flexibility in usage than the known devices and methods.

Still another object of the present invention is to provide an improved article metering device and method of metering articles which will allow the packaging machine operator to have greater control over the articles as they are moved along an article handling and packaging system to ensure that a sufficient supply of articles, properly spaced with respect to, and/or from one another, are available for being packaged at a downstream packaging machine.

Yet another object of the present invention is to provide an improved article metering device and a method of metering articles which is simple in design and construction, is easy to use, and which is rugged and durable in structure.

It is to these objects, as well as to the other objects, features, and advantages of the present invention, which will become apparent upon reading the specification when taken in conjunction with the accompanying drawings, to which the invention is directed.

DETAILED DESCRIPTION OF THE PREFERRED EMBODIMENTS

Figure 1:
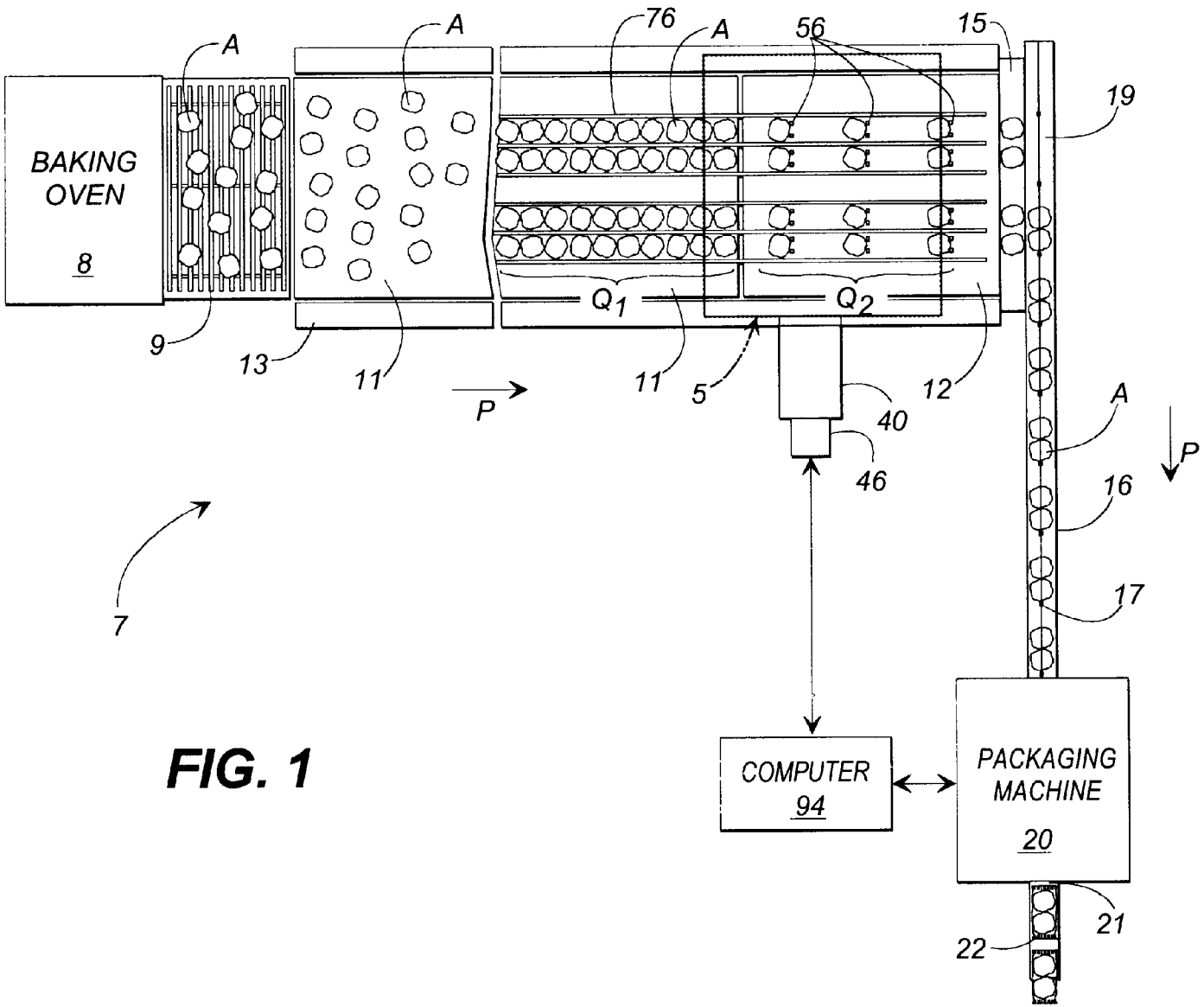
FIG. 1 is a schematic top plan view of an article handling and packaging system with which the article metering device of this invention is used.

Referring now in detail to the drawings, in which like reference characters indicate like parts throughout the several views, numeral 5 of FIGS. 1–4 illustrates a preferred embodiment of the article metering device of this invention. Article metering device 5 is provided as a part of an article handling and packaging system 7, such as that schematically illustrated. The article handling and packaging system 7 of FIG. 1 is shown for use in the production, handling, and packaging of baked foodstuffs to include baked cookies, crackers, snack cakes and the like. The article handling and packaging system will thus be provided with a baking oven 8 situated at an upstream end of a path of travel denoted by the reference character "P", and extending along the handling and packaging system. The baking oven 8 is provided with a cooling or take-away conveyor 9, typically a wire mesh or a chain conveyor which carries the unbaked articles, the articles being denoted by the reference character "A" throughout the drawings, through the baking oven, and then takes the baked articles away from the baking oven and allows them to cool prior to passing them on to the upstream end of an elongate endless downstream feed conveyor 11 extending along the path of travel. Positioned downstream of the feed conveyor along the path of travel is an elongate endless take-away conveyor 12.

Both the feed conveyor and the take-away conveyor are supported on an otherwise conventional frame 13 of a type known to those skilled in the art. As the articles pass along the path of travel from the feed conveyor to the take-away conveyor they pass beneath article metering device 5, and are then passed onto a downstream dead plate and combination pusher plate 15. The indexed or metered articles A allowed to be passed downstream along the path of travel by metering device 5 will land on the dead plate, the dead plate will then withdraw backward whereupon the articles will be swept onto an underlying stationary dead plate (not illustrated) by being moved against a stationary guide (not illustrated), whereupon the dead plate 15 then moves forward and sweeps the articles A onto an elongate and endless infeed conveyor 16, and more particularly into the flights 19 thereof formed by a spaced series of flight pins 17 extending the length of the infeed conveyor.

Once the articles are received within the respective flights of the infeed conveyor, they are moved toward a downstream packaging machine 20, for example a packaging machine of the type disclosed in U.S. Pat. No. 5,678,390, entitled, "Horizontal Form, Fill, and Seal Packaging Machine", the provisions of which are incorporated herein fully by this reference. Once the articles are packaged within the packaging machine 20 they are passed onto a downstream discharge conveyor 21, on which the now packaged articles 22 are carried for further processing downstream of the packaging machine.

Figure 2:
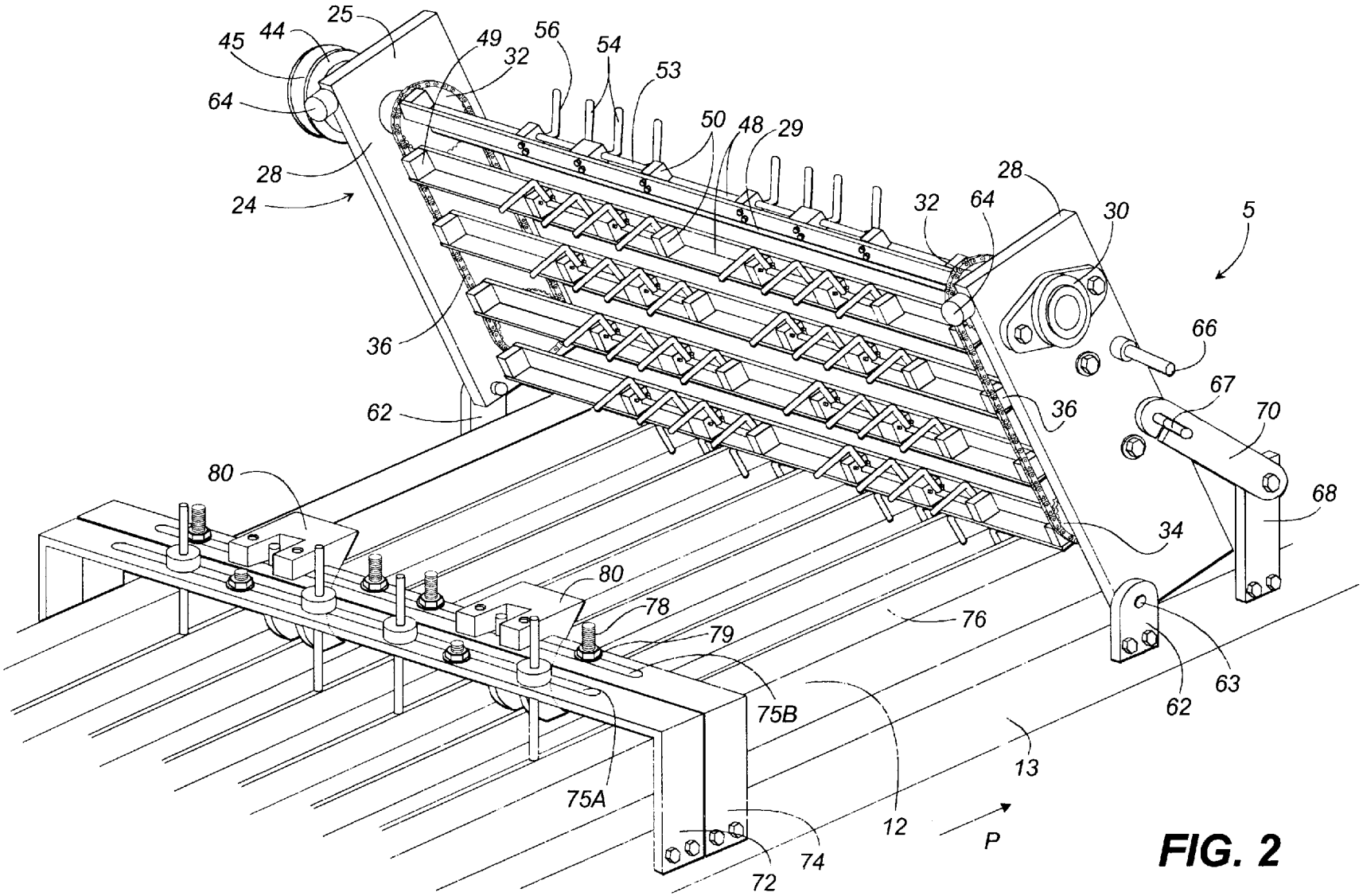
FIG. 2 is a perspective view of the article metering device of this invention shown in an open position on a frame provided as part of the article handling and packaging system of FIG. 1.
Figure 3:
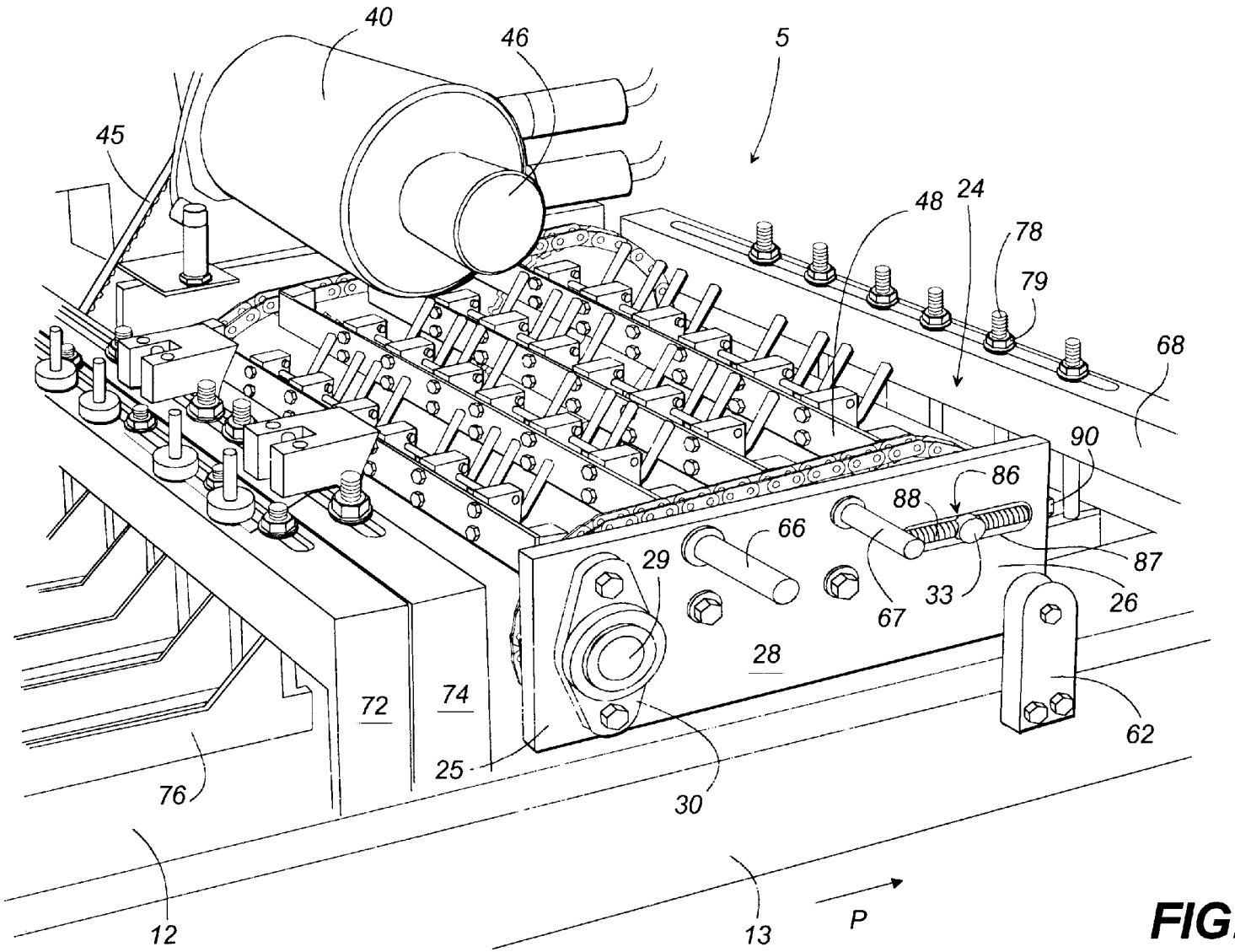
FIG. 3 is a perspective view of the article metering device of FIG. 2 shown in a closed position on the frame of the article handling and packaging system.
Figure 4:
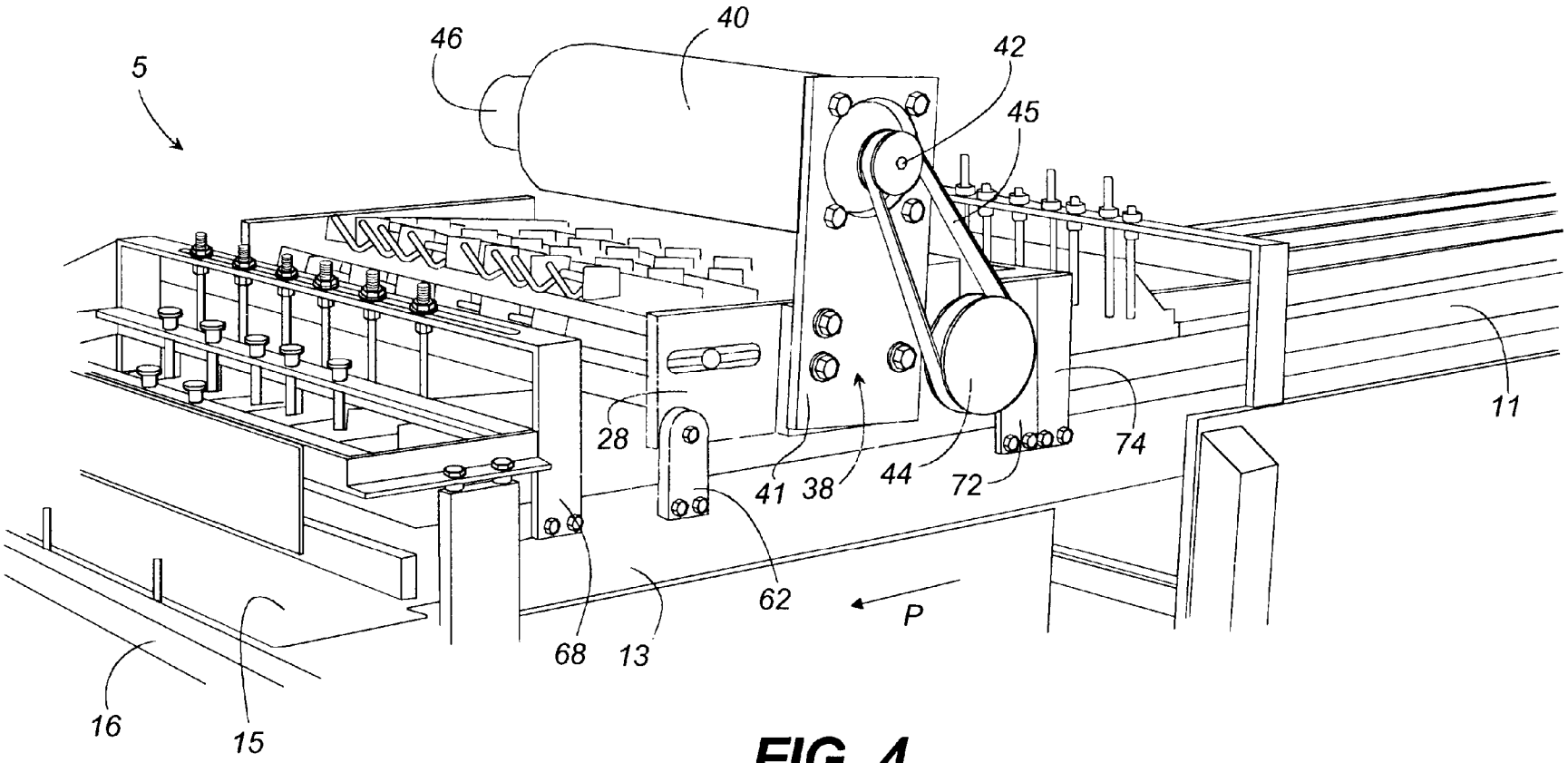
FIG. 4 is a perspective view of the drive assembly provided as part of the article metering device of FIGS. 2 and 3.

Article metering device 5 is illustrated in greater detail in FIGS. 2–5. Referring first to FIGS. 2–4, article metering device 5 is constructed of a framework 24 having a first upstream end 25, and a spaced second downstream end 26. Framework 24 also includes a pair of elongate spaced and parallel side frame members 28 which extend between the first and second ends thereof. An elongate drive shaft 29 is rotatably supported at the first end of the framework by a pair of bearing assemblies 30, one of which is illustrated in FIGS. 2 and 3, such that the drive shaft is freely rotatable. Bearing assemblies 30 may comprise roller bearings or other suitable types of bearing assemblies known in the art.

Affixed to drive shaft 29, as best shown in FIG. 2, is a pair of spaced, parallel, and toothed drive sprockets 32. A spaced elongate idler shaft 33 is also provided as a part of the article metering device, the idler shaft being affixed to the second end of this framework in the manner described in greater detail below. Provided as part of the idler shaft is a pair of spaced, parallel, toothed, and idler sprockets 34 rotatably supported thereon, which are aligned with respect to one each of the drive sprockets along the path of travel, such that the respective drive sprockets and idler sprockets are formed into two pairs of a drive sprocket and a spaced idler sprocket each, respectively.

An endless elongate drive chain 36 is passed about each pair of drive sprocket 32 and idler sprocket 34, such that the drive chains are spaced and parallel to one another, both of which will move along the path of travel between the first and second ends of the framework of the metering device. A chain guide (not illustrated) will be affixed to the inside surface of each respective one of the side frame members 28 for guiding the drive chain as it moves from the first end toward the second end of the framework.

Drive shaft 29 is rotated by a drive assembly 38, best shown in FIG. 4. The drive assembly includes a drive motor 40 affixed to a mounting plate 41, the mounting plate in turn being affixed to a respective one of the side frame members 28 of the framework of the article metering device. The mounting plate is affixed to the framework using conventional fasteners, or may be welded thereto if desired. The drive motor is affixed to the mounting plate by conventional fasteners. It is anticipated that the drive motor 40 will preferably be a servo-motor, although an AC or DC stepping motor may be used, if desired, as could other conventional AC/DC electric motors which may be used with an appropriate clutch or drive mechanisms for intermittently or continuously rotating drive shaft 29. It is anticipated, however, that by using a servo-motor 40 for rotating drive shaft 29, that a very high degree of precision control over the rotation of the drive shaft, and thus the operation of the article metering device, can be obtained.

Still referring to FIG. 4, a drive sprocket 42 is affixed to the output shaft of the drive motor. A spaced driven sprocket 44 is affixed to an elongate portion (not illustrated) of drive shaft 29 extending through a respective one of the bearing assemblies 30 of FIGS. 2 and 4. Passed about the drive sprocket and driven sprocket is an elongate endless drive belt 45, which in this instance is shown to be a toothed drive belt, also known to some in the art as a timing belt. It is anticipated that the drive sprocket 42 and driven sprocket 44 will be toothed for receiving the toothed drive belt thereon.

Lastly, an appropriate position feedback device 46 is also provided as a part of the drive assembly 38. When referring to the term "position feedback device" herein, it is understood by those skilled in the art that the position feedback device could comprise an encoder, a resolver, or a mechanical device, for example a flag which rotates on a shaft past a photoelectric or optical sensor for counting the rotation(s) of the shaft. However, where drive motor 40 is a servo-motor, position feedback device 46 will preferably be either an encoder or resolver such that a high degree of precision control over the operation of drive motor 40 can be obtained, and thus very precise control of the articles A will also be obtained as they are formed into a second queue $Q_2$ articles as shown in FIG. 1, and as described in greater detail further below, and then passed along the path of travel.

Referring now to FIGS. 2 and 4, article metering device 5 includes a series of spaced and parallel elongate carrier members 48, each of which is removably affixed to both of drive chains 36, and which extend in series between the first and second ends of the framework of the article metering device. It is anticipated that each of carrier members 48 will be an elongate piece of angle iron, or other suitable structural member, as desired. For the angle iron as shown in FIGS. 2 and 3, it is anticipated that a metallic end block 49 will be situated at each of the respective spaced ends of the carrier member, and affixed permanently thereto, for example by being welded or by being held thereto by a threaded fastener, for the purpose of adding structural rigidity to carrier member 48.

Still referring to FIGS. 2 and 3, and as also shown schematically in FIGS. 8A–8D, a series of spaced and parallel bearing blocks 50 are affixed to each one of the carrier members 48. These bearing blocks 50 will be affixed to the carrier member by suitable fasteners 52, which may comprise threaded screws, for example Allen head screws, hex head screws, or set screws. The bearing blocks will rotatably support, as shown in FIG. 2, a rotatable shaft 53 which is captured by the bearing blocks during assembly of the carrier members 48. As shown in FIG. 2, a pair of rotatable shafts 53, best thought of as two half shafts, are provided for each of carrier members 48. It is anticipated that a single elongate rotatable shaft (not illustrated) could be provided, if so desired, rather than two separate shafts. It is preferred that separate shafts 53 be used such that should an article become jammed or otherwise obstruct a portion of the article metering device, the remainder of the device can continue to operate in the preferred fashion, described below. The bearing blocks 50 are preferably comprised of plastic, for example an engineering plastic, polyethylene, polypropylene, polyvinyl chloride, or other synthetic plastic materials suitable for use as a bearing for rotatable shaft or shafts 53. Although a metallic material may also be used to construct bearing blocks 50, plastic is preferred due to its light weight, its relative durability, and its ability to journal shaft 53 thereon without the need for a bearing or lubricating assembly to support the shaft.

Each of carrier members 48 is provided with at least one, and in this instance several, spaced article engagement members 54, as shown in FIGS. 2–3, and FIGS. 6A–8D. The article engagement members 54 of FIGS. 2–3 are shown to be a pair of spaced and parallel L-shaped fingers 56, having one end affixed permanently to rotatable shaft 53, for example by being welded thereto, with a second end extending away therefrom at a 90° angle for use in engaging the articles A, as schematically illustrated in FIGS. 1, and 8A–8D. It is anticipated, although not illustrated, that the end of the L-shaped finger 56 affixed to rotatable shaft 53 may be affixed thereto within a pre-defined opening (not illustrated), and held in position by a set screw (not illustrated) such that the position of the finger with respect to the rotatable shaft 53 can be adjusted, when, and as desired.

Figure 7:
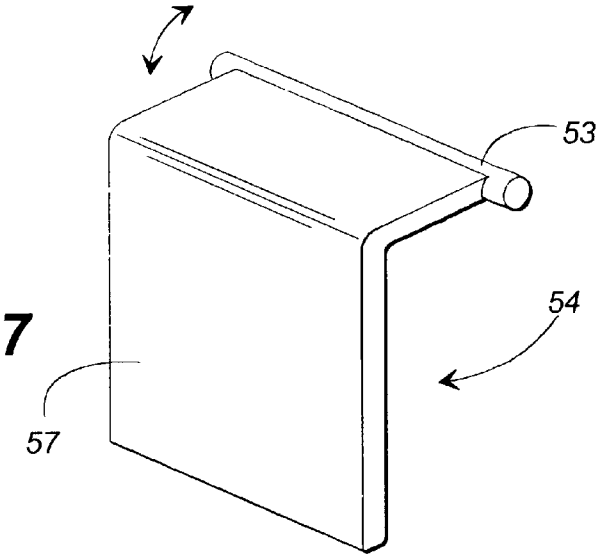
FIG. 7 is a perspective view of a separator blade constructed for use as an alternate embodiment of the article engagement member of this invention.

A second embodiment of article engagement member 54 is illustrated in FIG. 7, and is shown to be an elongate continuous L-shape separator blade 57, which is also schematically illustrated in FIGS. 8A–8D. Separator blade 57, for example, may be used where a large rectangular article, for example a baked snack cake or even a non-baked food article, for example a quadrilateral dry goods package, is being conveyed along the article handling and packaging system for being packaged at the packaging machine 20 (FIG. 1). Moreover, although separator blade 57 is shown as being permanently affixed by being welded to rotatable shaft 53, is anticipated that an elongate slot (not illustrated) may be machined within the respective rotatable shafts, and that the separator blade may be affixed thereto by a series of spaced set screws (not illustrated) tapped into the shaft whereupon the L-shaped separator blade may be adjustably positioned with respect to the shaft to which the separator blade is attached.

Figure 6B:
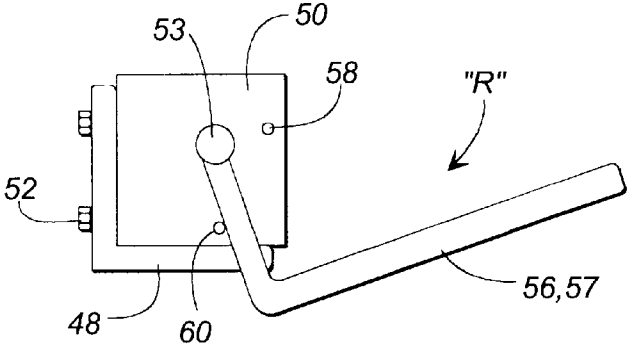
FIG. 6B is a schematic side elevational view of the article engagement member of FIG. 6A shown in its retracted position.
Figure 6A:
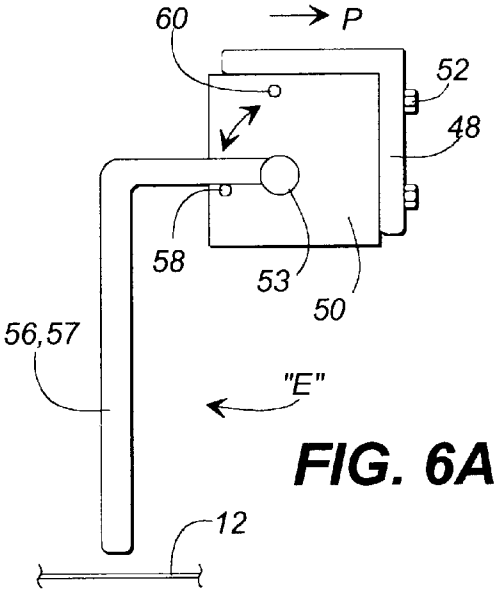
FIG. 6A is a schematic side elevational view of an article engagement member of the article metering device shown in an extended article engaging position.
Figure 8A:
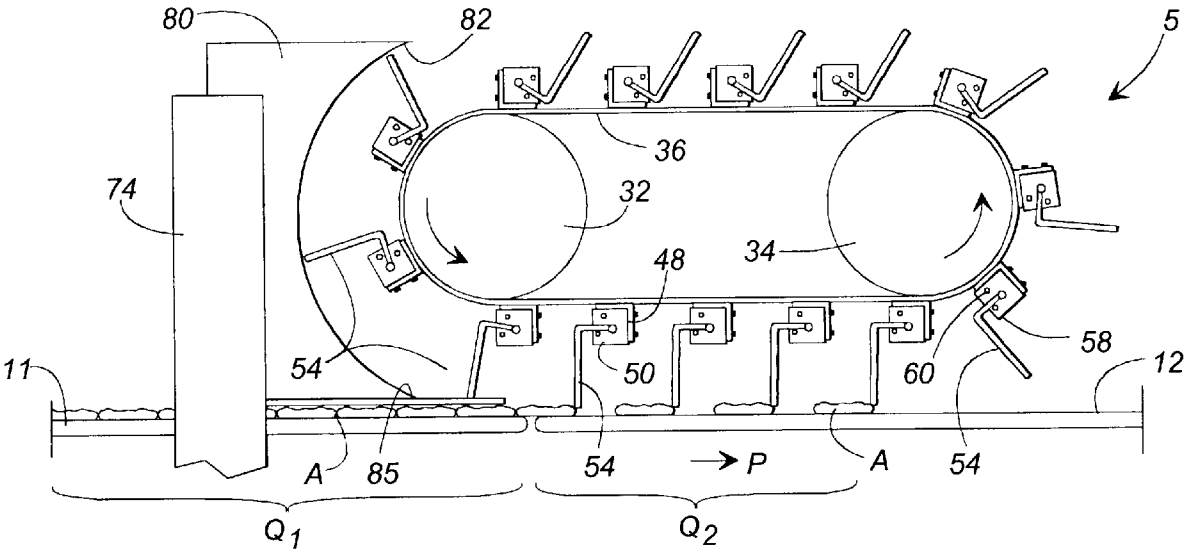
FIGS. 8A–8D are schematic sequential illustrations of the article metering device of FIGS. 2–7 in operation with the article handling and packaging system of FIG. 1, in which successive article engagement members are moved into an article receiving position, and are moved along a path of travel for forming a second accumulated queue of articles, and for spacing the articles thereof with respect to one another along the path of travel.

Each of bearing blocks 50 is provided with a first stop 58, and a radially spaced second stop 60 about the axis of shaft 53 journaled therein. As best shown in FIGS. 6A and 6B, and in FIGS. 8A–8D, the respective article engagement members 54 provided as part of each carrier member 48 are allowed to freely rotate, through the force of gravity, between a first extended or article engaging position "E", as shown in FIGS. 6A and 8A, in which the article engagement rests atop first stop 58, and a second retracted position "R", shown in FIG. 6B. The extended position is the position in which the article engagement member will be received on the first stop as the respective carrier members move from the first end toward the second end of the article metering device as shown in FIGS. 8A–8D.

As the respective carrier members are passed about the idler sprockets at the second end of the framework, and as rotatable shaft 53 is freely journaled within at least a pair of bearing blocks 50 (FIG. 2), the article engagement members will fall, through the force of gravity, from the first extended article engaging position shown in FIGS. 6A and 8A, into the second retracted position, as shown in FIG. 6B, and FIG. 8A, and back. The article engagement members 54 of each carrier member 48 will freely fall between the extended, retracted, and extended positions thereof (FIGS. 6A, 6B) through the force of gravity as the carrier members pass along the path of travel while moving between the first and second ends, respectively, of the article metering device framework, and vice versa.

So constructed, the article engagement members of this invention will not be forced, either by a spring or by mechanical motion, down toward or into engagement with the surface of the take-away conveyor 12, or any articles A carried thereon. Fingers 56, or separator blade 57, as the case may be, will fall through the force of gravity onto any articles A passing therebeneath if an article is otherwise out of position within the accumulated queue of articles. For example, if a soft baked cookie were to become jammed on the take-away conveyor beneath the metering device, fingers 56 will only fall onto the surface of the cookie, and thus the likelihood of either the cookie or the article engagement device being damaged from the force of the engagement device striking the cookie is greatly reduced. Similarly, if two frozen meat patties (not illustrated) are stuck to one another in a two-high stack as they enter the metering device, the fingers/separator blade will fall onto the uppermost patty and allow both patties to move downstream along the path of travel without damaging either the articles or the engagement device.

As best shown in FIGS. 2 and 3, the framework 24 of the article metering device is pivotally supported on the frame 13 of the article handling and packaging system by a pair of spaced parallel mounting members 62 affixed to frame 13, each mounting member having an opening (not illustrated) defined therein through which a pivot pin 63 is passed. The pivot pin 63 is also passed through a respective opening (not illustrated) defined within each one of the side frame members 28 of the article metering device framework. As shown in FIGS. 2 and 3, the mounting members, and the pivot pin, are affixed to the second end 26 of the framework 24. Accordingly, and provided as a part of the first end 25 of the framework, is a pair of resilient pads 64, or feet, affixed one each to each of the side frame members, such that as the framework is raised and lowered, and more particularly when it is lowered onto frame 13 of the article handling and packaging system, that neither of the frame 13, nor the framework 24 are damaged thereby.

Framework 24 is raised and lowered from its open position shown in FIG. 2, into its closed position, as shown in FIG. 3, and back, by grasping an elongate lift pin 66 affixed to the side frame member 28. An elongate locking pin 67 is also provided as a portion of this side frame member, and is held by a locking arm 70 pivotally affixed to a first frame member 68 positioned immediately downstream of the framework 24 of the article metering device. The locking arm 70 has a T-shaped slotted aperture 71 defined therein (FIG. 3), such that as the slot within the locking arm is passed over the locking pin, the lift pin being manually grasped by a machine technician, for example, the locking pin slides within the slotted aperture until it is received against one of the slotted ends thereof such that the framework 24 is held in the open position, as shown in FIG. 2. This allows for easy maintenance and repair of the metering device when needed, and also allows for the removal of any jammed articles which may otherwise accumulate within the second queue $Q_2$ (FIG. 1) formed by the metering device.

Each of the carrier members 48 is removably affixed to the drive chains 37 of the metering device. This allows the metering device to be quickly changed over from the ability to process large articles, for example, to smaller articles without the need for substituting an entirely new metering device, as such, in position on the frame 11 of the article handling and packaging system. Also, should any one carrier member be damaged, it becomes easy to provide a new carrier member which may be quickly and easily fastened in position along the drive chain for minimizing machine downtime, and increasing operating efficiencies.

Figure 5:
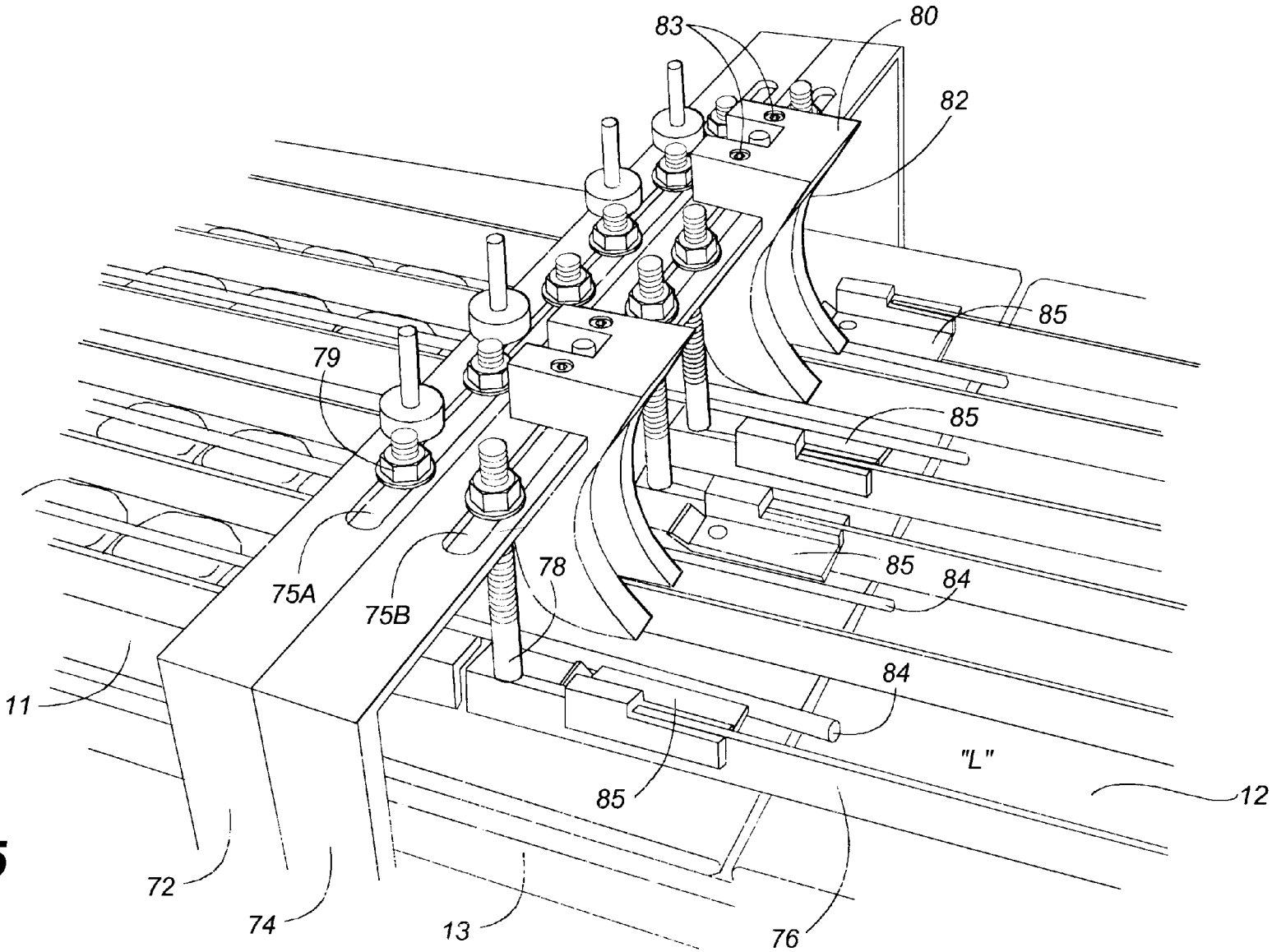
FIG. 5 is a partial perspective view of the frame members, guides, wear plates, and hold down rods provided as a part of the article metering device of FIGS. 2–4, and positioned at a first end of the article metering device.

Referring now to FIGS. 3 and 5, two upstream frame members, a second frame member 72, and a third frame member 74 adjacent the second frame member, are positioned at the upstream or first end 25 of framework 24, each of which is positioned above and extends across the width of feed conveyor 11, whereas the first (downstream) frame member 68 extends across only take-away conveyor 12. Each of the frame members 68, 72, and 74, respectively has an elongate slot 75*a*, 75*b* (FIG. 5) defined therein for use in adjustably positioning a series of parallel lane dividers 76, as best shown in FIGS. 2 and 5, along either of feed conveyor 11 and take-away conveyor 12. The lane dividers 76 are provided for defining separate and parallel article lanes, denoted by the reference character "L", so that the articles A, as shown in FIG. 1, will be held in parallel lanes of articles as they are moved toward and through the article metering device. The article metering device, as shown, will then form the articles into spaced parallel rows of articles. The articles will have been ordered into lanes while traveling along feed conveyor 11 toward the article metering device.

As shown schematically illustrated in FIG. 1, as the articles A are passed off of the cooling or take-away conveyor 9 onto the feed conveyor 11, they are generally in an unordered state. Through the use of guides or plows (not illustrated) situated along the feed conveyor, the articles are formed into lanes such that they pass into the lanes L of FIGS. 2 and 5, in line with the respective article engagement members 54 provided as a part of the article engagement device.

The lane dividers 76 are constructed of an elongate piece of thin steel flat stock, or any other conventional and rigid material approved for use in food handling systems, which may include stainless steel, a high polished carbon steel, or perhaps plastics, each divider having a pair of spaced and parallel threaded rods 78 permanently affixed thereto, as shown in FIG. 5, with one end of each respective threaded rod being passed through the elongate slot provided in the frame member in alignment with the separate lane dividers supported by the respective frame members. The respective threaded rods are held in position within the elongate slots 75*a*, 75*b*, respectively, by a separate threaded fastener 79, in this instance a nut, passed thereover and against a washer such that the lane dividers are adjustably positioned and spaced above the surface of feed conveyor 11 or of take-away conveyor 12, respectively By resting on washers as shown in FIG. 5, the lane dividers can be quickly and easily adjusted in width, as desired, and/or as necessary. This feature, in association with the construction of the carrier members 48 described above, allows for the quick changeover of the metering device for handling articles of any number of sizes and shapes.

Affixed to third frame member 74 are two spaced and parallel guides 80, formed of a suitable plastic material, for example polyethylene, which may also be the plastic material used to form bearing blocks 50. The guides 80 are held in position on third frame member 74, within slot 75*b*, by set screws 83. So constructed, the guides 80 can be moved laterally across the width of feed conveyor 11 for selectively positioning the guides in association with the first end of the metering device, and in particular where the article engagement members 54 of the article metering device will be positioned as the respective carrier members 48 pass about the drive sprockets 32 on the drive chains 36 along the path of travel from the first end toward the second end of the metering device.

Each of guides 80 has an arcuate exterior surface 82 defined as a part thereof, facing inwardly toward the first end of the framework of the metering device. The guides 80 are so constructed such that as the respective article engagement members freely pass from the retracted to the extended position, which occurs as the carrier members 48 pass about the drive sprockets toward the second end of the framework, a radial velocity will be imparted to the article engagement members 54 such that they will tend to move outward of the drive chain as they pass about the drive sprocket. In order to control this radial velocity so that the article engagement members do not slam downward into the wear plates 84 (FIG. 5) with excessive force, it is preferred that the article engagement member, in particular the distal end thereof, will engage the arcuate surface 82 of the guides 80 for the purpose of preventing a large radial displacement of the article engagement member and to control its associated radial velocity such that the article engagement member passes smoothly onto the exterior surface of respective one, or ones, of wear plates 85.

Each of the lanes L formed along the take-away conveyor 12 beneath the article metering device 5 are also provided with an elongate hold down rod 84 extending at least partially in the direction of the path of travel for the purpose of ensuring that as the articles A are held in a first queue $Q_1$ of articles, shown schematically in FIGS. 1, 8A–8D, that the articles will not tend to ride atop one another, or otherwise "tile" or become stacked such that they will foul or jam the feed conveyor, the take-away conveyor, and/or the article metering device.

As known of those skilled in the art, feed conveyor 11 will be continuously moving along the path of travel. As the articles are accumulated within the first queue $Q_1$ of articles (FIG. 1, FIGS. 8A–8D), they will be held in a relatively stationary position on conveyor 11 with respect to article metering device 5 until such time as the article metering device is used to form the second queue of articles $Q_2$. This is typically accomplished by having a slick "tabletop" conveyor, typically a continuous belt provided with a Teflon or other smooth impervious surface provided as a part thereof so that the articles may be held in a relatively stationary position as the belt continues to move therebeneath and along the path of travel.

In similar fashion, take-away conveyor 12 is also constructed as an endless conveyor moving in the direction of the path of travel, and the articles A held within the second queue $Q_2$ of articles (FIG. 1, FIGS. 8A–8D) are also held in a relatively stationary position thereon with respect to article metering device as the take-away conveyor continues to slide or pass beneath each of the articles within the second queue of articles. As the article metering device is operated, respective ones of the articles A within the first queue $Q_1$ articles will be moved forward and formed into the second queue $Q_2$ of articles accumulated by the metering device, at which time the articles will be moving in the direction of the path of travel with respect to the metering device. Take-away conveyor 12 will also be an endless tabletop type of conveyor formed of a continuous belt having a smooth impervious surface, coated with Teflon, or an other suitable plastic for use in carrying baked foodstuffs thereon.

The feed conveyor 11 will move at a first rate of speed in the direction of the path of travel, which first rate of speed will be less than the rate of speed at which the take-away conveyor will be moving along the path of travel. This occurs so that as the respective articles are passed from the downstream end of the feed conveyor onto the upstream end of the take-away conveyor they will be accelerated away from the remainder of the articles held in $Q_1$, such that a gap (FIGS. 8B–8C) will be created between the articles within the first queue of articles, whereupon a respective one of the article engagement members, either fingers 56, or separator blade 57, is allowed to fall downwardly off of a downstream end of wear plate 85 into the gap so created through the force of gravity, in fashion described in greater detail below.

Accordingly, the first rate of speed for the feed conveyor may be expressed by the formula: belt $speed_1$=rate×product length×percent over-speed. The percent over-speed is a speed rate selected by the packaging machine operator which will allow a sufficient quantity of articles A to be accumulated within the first queue of articles $Q_1$, and yet not so fast so as to cause the articles to tile or otherwise jam within the respective lanes L along the feed conveyor and the take-away conveyor of the article handling and packaging system 7. The rate of speed of the take-away conveyor may be expressed by the formula: belt $speed_2$=rate×desired spacing. The rate is the same for both of the belt speeds 1 and 2, multiplied by the amount of desired spacing once the articles are released from the downstream end of the article metering device, as shown schematically in FIGS. 8B–8D.

Although not illustrated herein, but as known to those of skill in the art, it is anticipated that a series of "prime" sensors will also be provided as a part of the article handling and packaging system 7, and positioned along feed conveyor 11 at spaced pre-determined positions such that when the accumulated first queue of articles $Q_1$ grows too large or too small, that the speed of the feed conveyor can be decreased or increased, respectively as needed to provide a relatively constant first queue $Q_1$ of articles. For example, a "high speed" prime sensor (not illustrated) will be positioned along the path of travel at the downstream end of the feed conveyor closest to article metering device 5, such that when there is not an article present below the high speed prime sensor, it will signal the drive system (not illustrated), of the feed conveyor, through a control processor 94 (FIG. 1) also used to control the operation of article packaging and handling system 7, to increase the speed of the feed conveyor in the direction of the path of travel for accumulating more articles A within the first queue $Q_1$ of articles. Positioned upstream of the high speed prime sensor will be a medium or normal run speed prime sensor (not illustrated) which will represent the desired size of the accumulated first queue of articles $Q_1$. Positioned still further upstream of the medium high speed sensor will be a low speed prime sensor (not illustrated) such that when it detects articles therebeneath in the accumulated first queue $Q_1$, it will signal the control processor 94 to slow the drive system for feed conveyor 11 such that the number of articles within $Q_1$ will be allowed to diminish until articles are no longer detected by the medium speed prime sensor, at which point the belt speed will be increased to the pre-determined normal operational speed.

As shown in FIG. 5, and as described above, each of the lanes L of articles formed along the feed conveyor and take-away conveyor will be provided with a wear plate 85 adjustably positioned along the path of travel at the downstream end of the feed conveyor 11, each of which is positioned with respect to the first, or upstream, end of the metering device. Each of wear plates 85 is a rectangular piece of plastic, preferably formed of the same material as are bearing blocks 50 and guides 80. Wear plates 85 are constructed and arranged to receive the distal ends of the respective article engagement members 54 thereon as the article engagement members, and more particularly the respective carrier members 48 to which they are attached, are passed about the drive sprockets at the upstream end of the framework 24 and begin moving toward the downstream end of the framework. These wear plates are positioned along the path of travel, and are spaced above the articles A within the first queue of articles $Q_1$.

Figure 8B:
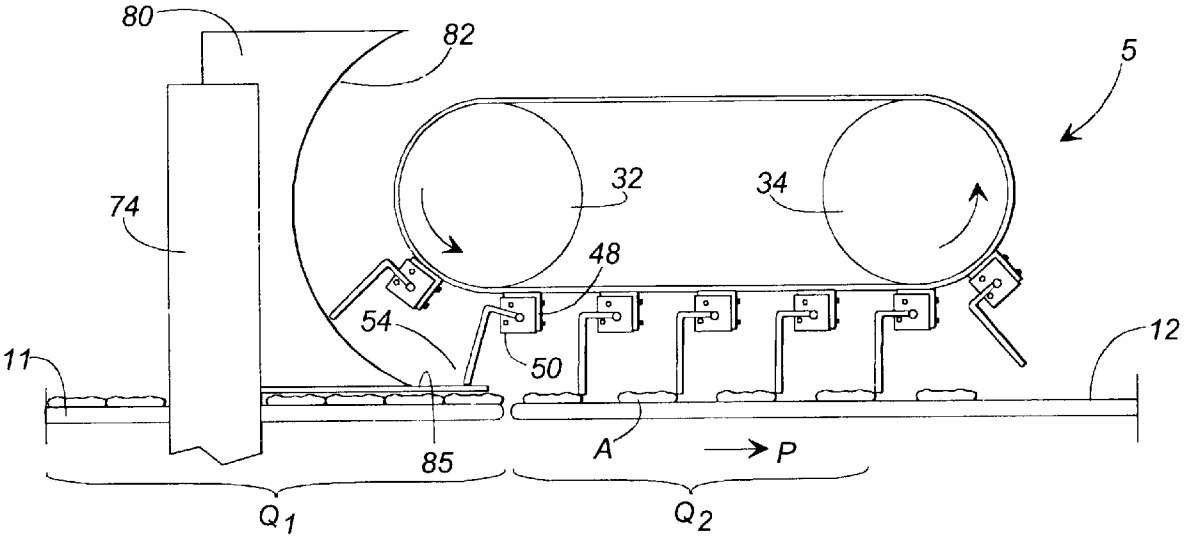
Figure 8C:
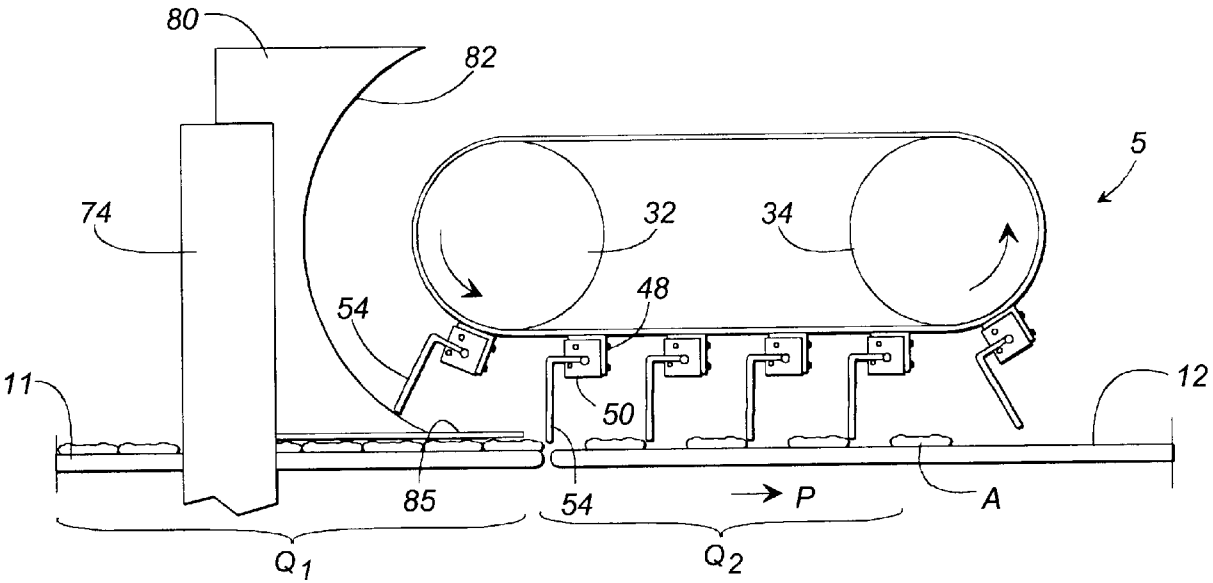
Figure 8D:
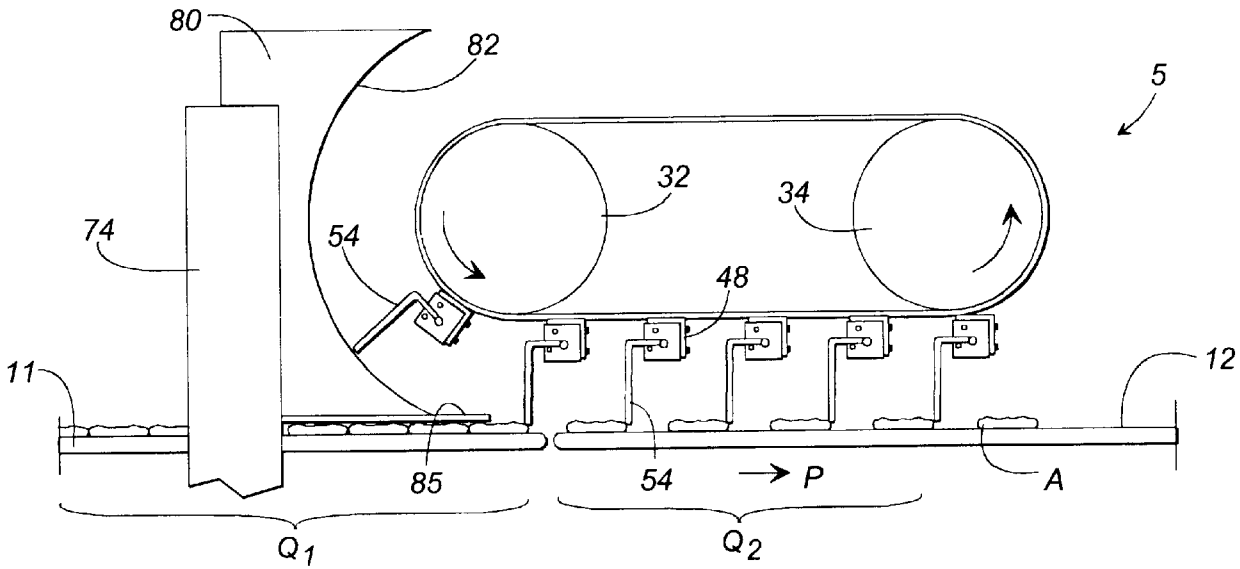

As best shown in FIGS. 8A–8C, as a first article engagement device 54 moves linearly along the direction of the path of travel, a second successive article engagement device 54 is already positioned with respect to the first queue of articles such that the distal end of the article engagement member is either received on the arcuate surface 82 of guide 80, or on the top surface of wear plate 85. As the drive chains 36 are moved in the direction of the path of travel, and as the first article engagement device thus also moves in the direction of the path of travel, the second article engagement device will also move in the direction of the path of travel, but will do so on the wear plate spaced above the articles until such time as it falls off of the downstream end of the wear plate and into the gap created between the articles as a respective one of the articles passes from the feed conveyor onto the take-away conveyor and is accelerated away therefrom. The fingers, or separator blade, respectively, fall off of the downstream end of the wear plate through the force of gravity.

As the article engagement member 54 falls off of the downstream end of the wear plate, it falls through the force of gravity only, into the gap created between the forward-most article within $Q_1$ and the remaining articles within $Q_1$ Thus, should the article engagement member strike the top surface of the next abutting article within $Q_1$, it will only do so with the force of gravity, and will not strike the surface of the article so hard so as to otherwise damage either the article, or the article engagement member. As shown in FIGS. 8A–8D, the article engagement member is spaced above the surface of feed conveyor 11 while in its extended or article engaging position, as well as above the surface of take-away conveyor 12. It is anticipated that the article engagement member will be spaced approximately 1/16" above the surface of the feed conveyor and the take-away conveyor, respectively, although this distance can be varied as desired.

Each of wear plates 85 is adjustably positionable along the path of travel, and is held by a conventional U-shaped clamp, or other clamping device, to a respective one of the lane dividers 76. As shown in FIG. 5, a hold down rod 84 will extend along the center line of each lane L, a wear plate 85 will be received on one side of the hold down rod, and an arcuate surface 82 of a respective one of guides 80 will be received on the other side of the hold down rod such that the distal end of the respective article engagement members 54 will pass smoothly from the arcuate surface 82 onto the wear plate 85 without otherwise slamming or jarring the article engagement member into the wear plate, thus increasing the service life of the article engagement members.

Idler shaft 33 of the article metering device is affixed to the framework 24 by an idler shaft position adjustment assembly 86, best shown in FIG. 3, so that the idler shaft can be moved toward and away from the drive shaft along the path of travel. This is accomplished by providing an elongate slot 87 defined within the downstream end of each side frame member 28, with an elongate threaded rod passed through the slot and being rotatably journaled (not illustrated) on the side frame member. A head 90 will extend from the downstream end of the side frame member, for example a hexagonal bolt head, which is rotated for rotating the threaded member in turn. The threaded member is threadably received within a threaded opening (not illustrated) defined within each respective end of the idler shaft 33, such that as the head 90 is rotated clockwise or counterclockwise, depending on whether right hand or left hand threads are used, the idler shaft will be moved away from or toward drive shaft 29. In this manner the position of the idler shaft can be adjusted as needed. Moreover, idler shaft position adjustment assembly 86 can be used to tension the drive chains to the desired level, because as is known, during continuous operation drive chains tend to stretch as they wear, and this will ensure that the drive chains remain taught to prevent any slippage of the drive chains off of either the respective drive sprockets or idler sprockets of the article metering device. This also allows the tension of the drive chains to be lessened when it is desired to change the drive chains out.

As shown schematically in FIG. 1, article handling and packaging system 7 may be provided with a computer 94 constructed and arranged to control packaging machine 20 in the fashion described in U.S. Pat. No. 5,678,390, included as a part of this application by reference. So constructed, computer 94 will be used to control the speed of drive motor 40 such that, and in fashion heretofore unknown in the art, article metering device 5 is operated in timed relationship to a downstream device, namely packaging machine 20, rather than in timed relationship to the speed of an upstream device, for example, feed conveyor 11. This takes full advantage of the modern generation of packaging machines described in U.S. Pat. No. 5,678,390, also known as the Mach 3® family of horizontal wrapping machines manufactured by Food Machinery Sales of Athens, Ga. Although not illustrated in FIG. 1, it is anticipated that the computer 94 can also be used to control the operation of conveyor belt 9, feed conveyor 11, take-away conveyor 12, as well as the operation of infeed conveyor 16. This, therefore, allows for greatly improved operating efficiency in that articles can now be metered, or spaced with respect to the speed of the downstream packaging machine 20, rather than with respect to the speed at with which the upstream feed conveyor 11, and/or conveyor 9, is operating.

OPERATION

The manner in which the article metering device 5 is used is illustrated in FIGS. 8A–8D. As schematically illustrated therein, article metering device 5 is positioned at the downstream end of feed conveyor 11, and at the upstream end of take-away conveyor 12, and extends parallel to and in the direction of the path of travel P. Schematically illustrated is drive sprocket 32, idler sprocket 34, and drive chain 36 passed thereabout. A spaced series of carrier members 48 are shown, each of which has at least a pair of bearing blocks 50 fastened thereto (See FIGS. 2–3), with at least one article engagement member 54 provided as a part thereof, the article engagement member(s) being affixed to a rotatable shaft 53, in the fashion described hereinabove. Also shown in FIGS. 8A–8D is the third frame member 74, immediately upstream of framework 24, to which a respective one of guides 80 is fastened. The arcuate surface 82 of guide 80 is positioned facing inwardly toward the drive sprocket of the article metering device. Also shown is a respective one of wear plates 85, spaced above the feed conveyor 11, and in particular above the articles A held within the first queue of articles $Q_1$, such that the distal ends of each respective article engagement member 54 are spaced above the articles, and allowed to freely fall thereoff and into the gap created between the respective articles A and the first queue of articles $Q_1$ as the articles pass from feed conveyor 11 onto take-away conveyor 12, as best shown in FIGS. 8B–8C.

It is known to those of skill in the art that feed conveyor 11, and take-away conveyor 12 will each be continuously operated such that they move in the direction of the path of travel. Feed conveyor 11 will be moving at a first rate of speed, whereas the take-away conveyor 12 will be moving at a second rate of speed greater than the first rate of speed. Therefore, as a respective article A from $Q_1$ is passed from the downstream end of the feed conveyor onto the upstream end of the take-away conveyor, the article tends to be accelerated away from the remaining articles within the first queue of articles $Q_1$, such that a gap is created therebetween. At the same time, as shown in FIGS. 8A–8C, the article metering device is being operated such that the carrier members 48 are being moved/carried in the direction of the path of travel from the first end toward the second end of the framework (FIGS. 2–5). As this happens, a first article engagement member, shown in the article receiving/engaging position in FIG. 8A, begins to move linearly in the direction of the path of travel. As it does so, a second successive article engagement member 54 is being carried along the path of travel by its carrier member, and is passing along the top surface of wear plate 85 in the direction of the path of travel as the articles within the first queue of articles $Q_1$ also move in the direction of the path of travel. As the gap is created between the articles, best shown in FIGS. 8B and 8C, the second successive article engagement member falls downwardly off of the downstream end of the wear plate through the force of gravity and into the gap created between the articles. This process continues sequentially for forming the selected ones of the articles of $Q_1$ into the second accumulated queue of articles $Q_2$ advanced along the path of travel. Once $Q_2$ is formed, a row or rows of selected articles (FIG. 1) may be selectively released by the article metering device and allowed to pass along the take-away conveyor 12 toward the downstream dead plate/pusher plate 15.

Article metering device 5 may be operated intermittently, or continuously, as desired. It is anticipated that in one form of operation, the article metering device will be indexed, i.e. will start and stop, for each row formed as a part of $Q_2$, and which rows are selectively released by the article metering device and allowed to be passed toward the infeed conveyor 16. During this operating cycle, a respective one of the article engagement members will move from the article receiving position (FIG. 8A) through a distance far enough to index the next article engagement member into the article receiving position once again. This is sequentially illustrated by FIGS. 8A–8D.

In a second mode of operation, control processor 94 will be programmed to calculate an electronic cam table "on the fly", and/or to implement one of a number of preprogrammed cam tables stored in the memory thereof. The manner in which this is accomplished is described in greater detail in U.S. Pat. Nos. 5,893,701, and 5,966,908, both of which are assigned to the Assignee of this invention, the provisions of each of which are incorporated fully herein by this reference. Accordingly, based on the feedback provided by packaging machine 20 to computer 94, and in turn from the signals emitted by computer 94 to drive motor 40, as well as the position feedback signals emitted from position feedback device 46 to computer 94, the article metering device may move the respective carrier members (drive chains) in the direction of the path of travel, from the first toward the second ends of the article metering device respectively, in a continuous motion, although this continuous motion will be comprised of an acceleration phase, a constant state speed phase, and a deceleration phase such that the respective carrier members travel through a constant cycle of being accelerated and decelerated.

It is anticipated that a dwell phase could also be programmed into the movement of the carrier/article metering device such that it would resemble a start/stop motion, although it would actually represent a gradual acceleration to a steady state speed, then a deceleration to a dwell period, during which it would appear to be stopped, whereupon it would accelerate and decelerate once again.

Lastly, based on the needs and operating efficiencies, of the handling and packaging system 7, as well as the operational speed of the packaging machine 20, article metering device 5 could be operated continuously, when, and as desired. Again, this could take the place of a continuous steady state speed or could represent a continuous acceleration and deceleration series of speed profiles being followed by the article metering device, as described above.

Also, although not illustrated in FIGS. 8A–8D, it is anticipated that article metering device 5 could be operated on a "timed" basis, if desired. In this type of operation, article metering device 5 would be indexed, i.e. would move from a stop to a start position, and then return to a stop position, after a predetermined measure of time has elapsed. This could, for example, be determined by a control program (not illustrated) held within control processor 94, using programmable limit switches (PLS) in the fashion described for the operation of packaging machine 20 within U.S. Pat. No. 5,678,390, referenced above.

As shown in FIG. 1, in operation, a randomly ordered supply of articles A on the upstream end of feed conveyor 11 are formed into parallel lanes of articles at the downstream end thereof, positioned between lane dividers 76 into a predetermined number of lanes L, as desired. The articles are held within a first queue of articles $Q_1$, accumulated on the feed conveyor by the article metering device. As the articles are formed into a second accumulated queue of articles $Q_2$ by the article metering device on take-away conveyor 12, the articles will also be formed into spaced rows of articles across the lanes of articles. Thereafter, the rows are selectively released from the downstream end of the article metering device in the fashion described above, and passed on to dead plate 15, and then into a respective one of the flights of infeed conveyor 16 for being packaged by packaging machine 20. This is all accomplished in heretofore unknown fashion by operating article metering device 5 in timed relationship with respect to the operation of the downstream packaging machine 20.

In use, therefore, article metering device 5 can be used to selectively release selected rows of articles along the path of travel in accordance with the needs of packaging machine 20. For example, should a machine operator shut down packaging machine 20, article metering device 5 will itself stop, and the articles within $Q_2$ will not be released until such time as packaging machine 20 is started once again. Moreover, should a machine operator increase the speed of packaging machine 20, then the rate at which the rows of articles within $Q_2$ will be released by article metering device 5 will be increased, and vice versa.

As the article metering device 5 is indexed, shown in FIGS. 8A–8D, it is anticipated that the drive chain will move at a rate of speed slightly greater than a rate of speed of take-away conveyor 12, such that as the indexing operation is performed, i.e. as the article engagement members are stopped in their respective positions downstream and along the path of travel, that the articles within the second queue of articles $Q_2$ will be urged against the article engagement members 54. By operating in this fashion, the articles are not otherwise slammed or accelerated downstream by an article engagement member pushing the articles, rather the articles are allowed to move gently into the respective article engagement members, which minimizes the likelihood of damaging the articles. It is also anticipated, however, that the drive chains 36, and thus article engagement members, can be driven in the direction of the path of travel at substantially the same rate of speed as that of take-away conveyor 12 when, and as desired. Lastly, carrier members 48 can be moved in the direction of the path of travel at a rate of speed slower than the rate of speed of the take-away conveyor, if desired, whereupon the article will always remain positively engaged, i.e. will be constantly urged into, a respective one of the article engagement members 54 as they move along the path of travel on take-away conveyor 12 with the second queue of articles $Q_2$.

While preferred embodiments of the invention have been disclosed in the foregoing specification, it is understood by those skilled in the art that variations, and modifications thereof can be made without departing from the spirit and scope of the invention, as set forth in the following claims. In addition, the corresponding structures, materials, acts, and equivalents of all means or step plus elements in the claims below, are intended to include to any structure, materials or acts for performing the described or claimed functions in combination with other claimed elements, as specifically claimed herein.

I claim:

1. A method of metering articles, the articles being advanced along a path of travel on a feed conveyor toward a downstream infeed conveyor of a packaging machine, said method comprising the steps of:

accumulating a first queue of articles on the feed conveyor with a metering device positioned along the path of travel with respect to the feed conveyor by moving an article engagement member provided as a part of the metering device in a linear direction along the path of travel, stopping the article engagement member at a predetermined position along the path of travel in front of the articles being carried on the feed conveyor, and forming the first queue of articles upstream of said article engagement member on the feed conveyor in response thereto;

accumulating a second queue of articles on a take-away conveyor positioned downstream of the feed conveyor with the metering device by moving said article engagement member from its predetermined position in said linear direction along the path of travel, and then moving a second successive article engagement member along the path of travel and into said predetermined position in front of the remaining ones of the articles within said first queue of articles, and spacing the respective articles within the second queue of articles from one another with the metering device; and selectively advancing the articles within the second queue of articles along the path of travel toward the infeed conveyor of the packaging machine;

wherein the step of moving the second article engagement member into said predetermined position includes the step of moving the second article engagement member into a gap created between adjacent ones of the articles within the first queue of articles as the articles are passed from the feed conveyor onto the take-away conveyor;

and wherein the step of moving the second article engagement member into said gap includes the steps of moving the article engagement member in said linear direction along the path of travel in engagement with a wear strip extending in the direction of the path of travel and spaced above at least a portion of the first queue of articles, and then moving the article engagement member downwardly into said gap with the force of gravity as the article engagement member falls off of a downstream end of said wear strip.

2. The method of claim 1, further comprising the steps of selectively placing the articles of the second queue of articles on the infeed conveyor and advancing the articles toward the packaging machine.

3. The method of claim 2, further comprising the steps of packaging the articles with the packaging machine, and timing the operation of said metering device with respect to the operation of the packaging machine.

4. The method of claim 1, further comprising the steps of forming the articles on the feed conveyor into a plurality of separate lanes of articles, moving the articles within each said lane of articles toward the metering device, and forming the articles within the respective lanes of articles into a series of spaced rows of articles across said lanes on the take-away conveyor with said metering device.

5. The method of claim 4, further comprising the steps of selectively releasing the rows of articles so formed one row at a time from said metering device, and advancing the rows of articles so released along the path of travel toward the packaging machine infeed conveyor.

6. The method of claim 1, wherein the step of accumulating the first queue of articles on the feed conveyor includes the step of holding the articles of said first queue in a relatively stationary position on the feed Conveyor with respect to the metering device as the feed conveyor moves in the direction of the path of travel therebeneath.

7. The method of claim 1, wherein the step of accumulating the second queue of articles on the take-away conveyor includes the step of holding the articles of said second queue on the take-away conveyor in a relatively stationary position with respect to the metering device as the take-away conveyor moves in the direction of the path of travel therebeneath.

8. The method of claim 7, further comprising the step of urging the articles within said second queue of articles against said article engagement member.

9. The method of claim 1, wherein the step of moving said second article engagement member into said predetermined position includes the step of moving said second article engagement member along the path of travel at a rate of speed greater than the rate of speed of the feed conveyor.

10. The method of claim 1, wherein the step of moving said second article engagement member into said predetermined position includes the step of substantially matching the speed of said second article engagement member to the speed of the take-away conveyor, the take-away conveyor having a greater rate of speed along the path of travel than the feed conveyor.

11. The method of claim 1, further comprising the steps of moving successive ones of the article engagement members in said linear direction along the path of travel and into said predetermined position as the respective article engagement members are moved by said metering device along the path of travel.

12. The method of claim 1, wherein the step of selectively advancing the articles of the second queue of articles along the path of travel toward the packaging machine infeed conveyor with said metering device includes the step of varying the speed of said metering device in the direction of the path of travel in response to speed changes in the operation of the packaging machine.

13. The method of claim 1, wherein the step of selectively advancing the articles of the second queue of articles along the path of travel toward the packaging machine infeed conveyor includes the step of indexing the movement of the articles within said second queue of articles in the direction of the path of travel.

14. The method of claim 13, wherein the step of indexing the movement of the articles within said second queue of articles includes the steps of selectively starting and stopping the movement of said article engagement member in said linear direction along the path of travel, and starting and stopping the movement of the articles within said second queue in response thereto.

15. The method of claim 13, wherein the step of indexing the movement of the articles within said second queue of articles includes the steps of selectively increasing and decreasing the speed of said article engagement member in said linear direction along the path of travel, and of increasing and decreasing the speed of the movement of the second queue of articles in the direction of the path of travel in response thereto.

16. The method of claim 1, wherein the step of selectively advancing the articles of the second queue of articles along the path of travel toward the infeed conveyor includes the steps of calculating an electronic cam profile with a computer in communication with the metering device and the packaging machine in response to the operation of the packaging machine, and in response thereto indexing the movement of the articles within said second queue of articles in the direction of the path of travel in accordance with said electronic cam profile.

17. An article metering device for use with an article handling and packaging system, the article handling and packaging system having an endless feed conveyor moving along a path of travel, an endless take-away conveyor positioned downstream of the feed conveyor, and an endless infeed conveyor positioned downstream of the take-away conveyor and extending toward a packaging machine, and a plurality of articles to be packaged carried on the feed conveyor, said metering device comprising:

a framework positioned along the path of travel with respect to the feed conveyor and the take-away conveyor, said framework having a first end, a spaced second end, and a pair of spaced and parallel side frame members extending between the ends of said framework;

a plurality of elongate carrier members extending between said side frame members, said carrier members being carried in spaced series on a drive means for moving said carrier members along an elongate and endless path extending between the first and second ends of said framework;

said drive means comprising:

a rotatable drive shaft and a spaced parallel idler shaft each supported on said framework;

a pair of spaced drive sprockets affixed to said drive shaft and a pair of spaced idler sprockets mounted on said idler shaft;

a pair of spaced endless drive chains passed about a respective one of said drive sprockets and said idler sprockets and extending between the first and second ends of said framework; and a drive motor for rotating said drive shaft;

wherein each of said carrier members is removably affixed to each of said drive chains and is carried thereby along said endless path between the first and second ends of said framework;

at least one article engagement member carried on each respective said carrier member, each said at least one article engagement member being constructed and arranged to fall from a first retracted position through the force of gravity into a second extended article engaging position spaced above the take-away conveyor in said article engaging position; and an elongate wear strip spaced above the feed conveyor and extending partially along the path of travel with respect to the first end of said framework, said wear strip being sized and shaped to receive said at least one article engagement member thereon as the respective ones of said carrier members successively pass about the drive sprockets along said endless path so that said wear strip supports each said at least one article engagement member thereon as it is moved along the path of travel, whereupon said at least one article engagement member then falls off of a downstream end of said wear strip and into said article engaging position.

18. An article metering device for use with an article handling and packaging system, the handling and packaging system having a frame, an endless feed conveyor supported on the frame, a plurality of articles carried on the feed conveyor along a path of travel toward an endless downstream take-away conveyor also supported on the frame, and an endless downstream infeed conveyor extending toward a packaging machine for packaging the articles thereby, said article metering device comprising:

an elongate framework having a first end and a spaced second end, said framework being supported on the frame of the packaging system with respect to the downstream end of the feed conveyor and the upstream end of the take-away conveyor;

an elongate drive shaft rotatably supported on said framework, and a pair of spaced parallel drive sprockets affixed to said drive shaft;

a spaced parallel idler shaft supported on said framework, and a pair of spaced parallel idler sprockets rotatably mounted to said idler shaft;

drive means for rotating said drive shaft;

a pair of spaced parallel and endless drive chains passed about a respective one of said drive sprockets and said idler sprockets and extending between the first and second ends of said framework along an endless path;

a plurality of elongate carrier members fastened in spaced series to said pair of drive chains and extending the length of said drive chains;

at least one article engagement member carried on each respective one of said carrier members, each said at least one article engagement member being pivotally carried on its respective carrier member in a first retracted position as the carrier member moves from the second end toward the first end of the framework, and being constructed and arranged to then fall into a second extended article engaging position through the force of gravity as said carrier member passes about the drive sprockets and moves from the first end toward the second end of the framework; and at least one guide positioned with respect to the first end of said framework, said at least one guide having an arcuate surface defined thereon, said arcuate surface being sized and shaped to receive said at least one article engagement member thereon and to control the radial velocity thereof as the respective ones of said carrier members are carried on said drive chains about said drive sprockets while moving from the first end toward the second end of said framework.

19. The metering device of claim 18, wherein each said carrier member is removably affixed to said drive chains.

20. The metering device of claim 18, wherein said framework and said idler shaft are constructed and arranged such that said idler shaft may be adjustably positioned along the path of travel with respect to said drive shaft.

21. The metering device of claim 18, wherein said framework is constructed and arranged to be pivotally moved from a first lowered position on the frame of the packaging system positioned above the take-away conveyor into a second raised position and back.

22. The metering device of claim 18, further comprising at least one pair of spaced bearing blocks affixed to each respective one of said carrier members, at least one elongate shaft rotatably supported by said bearing blocks, wherein a respective one of said at least one article engagement members is affixed to said shaft, and a stop mounted on at least one of said bearing blocks for receiving said at least one article engagement member thereon in said article engaging position.

23. The metering device of claim 18, further comprising an elongate article hold down rod positioned with respect to the first end of said framework and extending at least partially along the path of travel.

24. The metering device of claim 18, wherein said at least one article engagement member comprises a pair of spaced elongate and parallel L-shaped fingers.

25. The metering device of claim 18, wherein said at least one article engagement member comprises an elongate L-shaped separator blade.

26. The metering device of claim 18, further comprising at least a pair of spaced and parallel guide rails spaced above and extending at least partially along the length of the take-away conveyor, and which together define at least one article lane therebetween.

27. The metering device of claim 18, wherein said drive means for rotating said shaft comprises a servo-motor and a position feedback device operatively coupled to said servo-motor.

28. The metering device of claim 18, wherein said drive means is constructed and arranged to be driven in timed response to the operation of the downstream packaging machine.

29. An article metering device for use with an article handling and packaging system, the handling and packaging system having a frame, an endless feed conveyor supported on the frame, a plurality of articles carried on the feed conveyor along a path of travel toward an endless downstream take-away conveyor also supported on the frame, and an endless downstream infeed conveyor extending toward a packaging machine for packaging the articles thereby, said article metering device comprising:

an elongate framework having a first end and a spaced second end, said framework being supported on the frame of the packaging system with respect to the downstream end of the feed conveyor and the upstream end of the take-away conveyor;

an elongate drive shaft rotatably supported on said framework, and a pair of spaced parallel drive sprockets affixed to said drive shaft;

a spaced parallel idler shaft supported on said framework, and a pair of spaced parallel idler sprockets rotatably mounted to said idler shaft;

drive means for rotating said drive shaft;

a pair of spaced parallel and endless drive chains passed about a respective one of said drive sprockets and said idler sprockets and extending between the first and second ends of said framework along an endless path;

a plurality of elongate carrier members fastened in spaced series to said pair of drive chains and extending the length of said drive chains;

at least one article engagement member carried on each respective one of said carrier members, each said at least one article engagement member being pivotally carried on its respective carrier member in a first retracted position as the carrier member moves from the second end toward the first end of the framework, and being constructed and arranged to then fall into a second extended article engaging position through the force of gravity as said carrier member passes about the drive sprockets and moves from the first end toward the second end of the framework; and at least one elongate wear strip positioned with respect to the first end of said framework and extending at least partially in the direction of the path of travel, said at least one wear strip being sized and shaped to receive said at least one article engagement member thereon as the respective carrier members are carried on said drive chains about said drive sprockets, and to support said at least one article engagement member thereon as the respective article engagement members move in the direction of the path of travel until such time that each respective article engagement member falls off of a downstream end of said wear strip downwardly into said article engaging position.

30. The metering device of claim 29, wherein each said carrier member is removably affixed to said drive chains.

31. The metering device of claim 29, wherein said framework and said idler shaft are constructed and arranged such that said idler shaft may be adjustably positioned along the path of travel with respect to said drive shaft.

32. The metering device of claim 29, wherein said framework is constructed and arranged to be pivotally moved from a first lowered position on the frame of the packaging system positioned above the take-away conveyor into a second raised position and back.

33. The metering device of claim 29, further comprising at least one pair of spaced bearing blocks affixed to each respective one of said carrier members, at least one elongate shaft rotatably supported by said bearing blocks, wherein a respective one of said at least one article engagement members is affixed to said shaft, and a stop mounted on at least one of said bearing blocks for receiving said at least one article engagement member thereon in said article engaging position.

34. The metering device of claim 29, further comprising an elongate article hold down rod positioned with respect to the first end of said framework and extending at least partially along the path of travel.

35. The metering device of claim 29, further comprising at least a pair of spaced and parallel guide rails spaced above and extending at least partially along the length of the take-away conveyor, and which together define at least one article lane therebetween.

36. The metering device of claim 29, wherein said drive means for rotating said shaft comprises a servo-motor and a position feedback device operatively coupled to said servo-motor.

37. The metering device of claim 29, wherein said drive means is constructed and arranged to be driven in timed response to the operation of the downstream packaging machine.

* * * * *